United States Patent [19]

Boda

[11] Patent Number: 5,067,868

[45] Date of Patent: Nov. 26, 1991

[54] SWING EJECTOR FOR REAR LOADING COMPACTOR

[75] Inventor: Robert A. Boda, Rochester, Minn.

[73] Assignee: McNeilus Truck and Manufacturing, Inc., Dodge Center, Minn.

[21] Appl. No.: 535,368

[22] Filed: Jun. 8, 1990

[51] Int. Cl.[5] ..... B65F 3/28

[52] U.S. Cl. ..... 414/510; 100/233; 414/517

[58] Field of Search ..... 414/509–517, 414/525.1, 525.5–525.53; 100/233

[56] References Cited

U.S. PATENT DOCUMENTS

| | | | |
|---|---|---|---|
| 2,430,973 | 11/1947 | Boissonnault | 100/233 X |
| 2,693,890 | 11/1954 | Bridge | 414/509 |
| 2,889,944 | 6/1959 | Clark et al. | 414/517 X |
| 2,911,119 | 11/1959 | Kuhnau | 414/517 X |
| 3,688,944 | 9/1972 | Gagel | 414/509 X |
| 4,145,824 | 3/1979 | Watson | 100/233 X |
| 4,221,527 | 9/1980 | Morrison | 414/525.5 X |
| 4,475,862 | 10/1984 | Paulsson et al. | 414/513 |

*Primary Examiner*—David A. Bucci

*Attorney, Agent, or Firm*—Haugen and Nikolai

[57] ABSTRACT

An improved pivoting ejector mechanism is disclosed for use in a rear-loading refuse compacting and hauling truck which adds a significant amount of useful refuse stowage capacity.

7 Claims, 2 Drawing Sheets

SWING EJECTOR FOR REAR LOADING COMPACTOR

BACKGROUND OF THE INVENTION

1. Field of the Invention

The present invention is directed primarily to truck bodies designed specifically for refuse hauling trucks and, more particularly, to an improved ejection mechanism for rear-loading refuse compactors which adds a significant amount of useful stowage capacity to the truck body.

2. Description of the Related Art

Refuse pick-up trucks commonly include a truck chassis fitted with a distinctly configured body that is completely designed and built and installed on the chassis by a manufacturer other than the manufacturer of the chassis. The truck body is, then, specifically designed for receiving, compacting, hauling and discharging refuse materials and includes all the associated operating mechanisms. One very successful design of refuse hauling truck bodies is known as a "rear loader" and includes a refuse hauling reservoir accessible for loading and discharge from the rear of the vehicle. This system includes an hydraulic compacting mechanism which repeatedly compacts the refuse after each loading. In this manner refuse eventually fills the available or useable reservoir volume extending from the front end back toward the rear of the body until no more material can be compacted.

The forward wall against which the refuse is compacted in a typical rear-loading truck body also forms part of a cylinder-operated ejection mechanism which, in effect, moves the front wall aft on an horizontal plane, in the manner of a plow, to expel the entire contents of the refuse volume during ejection. Typically, the bottom portion of the ejection mechanism is supported on a plurality of load-bearing sliders adapted to slidably support the ejector system just above the truck body floor. In many such truck models, the bottom portion of the truck body is provided with a central recessed trough extending beneath the central portion of the ejector in the form of a central longitudinal ejection cylinder trough running the length of the body. An hydraulic cylinder which mounts behind the cab on the truck chassis is designed to mount in and to operate along the trough and move the ejector system fore and aft in the refuse collecting body. A portion of the ejector system extends down into the central longitudinal trough and is fitted with a plate which is, in turn, fastened to the end of the operating piston of the hydraulic cylinder.

The cylinder is operated to position the ejector system as desired. When the cylinder is fully retracted, the ejector is in the fully forward position as when the truck is fully loaded with refuse. When the cylinder is fully extended the ejector mechanism is moved fully aft of the truck body to a position where the refuse will be completely expelled.

It will be appreciated that the length of the cylinder requires that, even in its fully retracted position, a distance up to one-third the length of the fully extended cylinder and piston is required between the rear of the cab and the point at which the cylinder engages the ejection mechanism. This means that even in the fully contracted configuration, the cylinder takes up considerable space along the central longitudinal trough. In order to accommodate the operating cylinder beneath the ejector mechanism, the design of the ejector mechanisms has had to be such that the bottom portion of the ejector mechanism extend a considerable distance into the useful reservoir or volume of the truck. This has led to conventional body designs in which the ejector mechanism vertically follows the front wall of the available reservoir space for a short distance below the top of the truck body but then is thereafter required to angle sharply toward the rear of the truck body, away from the front wall. While it solves the problem of ejector operation, it renders a rather large wedge-shaped volume in the lower front portion of the refuse reservoir unusable. In a large truck, this unused space may amount to several cubic yards and considerably reduces the effective volume of a given sized rear-loading refuse compactor body.

If the wasted space associated with the conventional ejection mechanism could be reduced or eliminated, it would present a distinct step forward in the art of rear-loading, compacting refuse truck body design. This would result, of course, in more efficient use of the possible reservoir volume for the purposes intended.

SUMMARY OF THE INVENTION

By means of the present invention, the wasted space associated with the prior ejector designs for rear-loading refuse compactors is greatly reduced or substantially eliminated by the provision of an improved ejector system which eliminates the wasted space of the "wedge" area associated with conventional ejector mechanisms. The use of this space for refuse also has the added advantage of shifting more of the weight to the front axle.

The improved ejector system of the present invention includes a frame which is designed to fit or substitute for the front or nose portion of the refuse collecting reservoir. The frame includes a bottom portion and two side walls, which, when vertical, further define a rearward descending acute angle extending upward from the bottom portion. This frame, then, generally defines a structure resembling a pair of spaced "A-shaped" sides connected by a bottom framework. A generally scoop shaped ejector mechanism is pivotally mounted from a pair of pivot or journal support devices, one mounted on the top of each "A" section of the frame. The ejector, then, resembles a rather large scoop-shaped "swing" mounted between side frames in a manner such that the scoop is free to pivot or swing back and forth between side frames. This device is mounted in place of the conventional ejector mechanism in the front of the rear-loading compactor body in a manner such that the bottom portion of the scoop member may form the forward wall of the rear-loading compactor body reservoir. The bottom of the swing ejector mechanism has a design resembling a conventional ejector mechanism which may allow it to be retrofitted into existing bodies. Thus, the frame is extended downward to accommodate a longitudinally-mounted cylinder which may be used to operate the ejector mechanism in a conventional manner moving it forward and aft within the truck body.

The pivotally mounted scoop member is carried by a pair of shafts journalled in bearings mounted on the side frames and is preferably designed and mounted such that the center of gravity in the free state will cause the bottom to swing forward matching the angled front lip of the ejector mechanism to provide a smooth discharge chute for refuse during the ejection portion of the operation. During the loading portion of the operating cycle, the ejector is in the fully extended position as after unloading. The refuse loaded in the rear loader is continually compressed or compacted and pushed back against the ejector causing the ejector operating cylinder to collapse or retract. Eventually, in the fully loaded configuration, the lower portion of the scoop is displaced and pivoted rearward such that the bottom of the scoop provides a slightly curved but substantially vertical front wall for the refuse collecting reservoir. The increased stowage volume displaced by the operation of the swing ejector system of the invention provides a great deal of increased volume for refuse storage as the truck is loaded.

In conjunction with the operation of the swing ejector mechanism, tabs or ears may be provided on the swingably mounted scoop which cooperate with positive stops fore and aft within the truck body to produce positive pivoting of the swinging scoop in a manner such that when the ejector is fully retracted in the loading position the ears are pushed rearward, which, in turn, causes the top of the swing to pivot back toward the rear of the truck body thereby displacing the bottom portion of the scoop forward and increasing the available volume for storage. Conversely, positive stops provided toward the rear of the truck body engage the top of the swiveling scoop as the ejector mechanism is pushed toward the rear of the truck by the cylinder in a manner which causes the bottom portion of the scoop to swing outward toward the rear of the truck thereby assuring complete discharge of the refuse contained in the truck. The stops operate in conjunction with the swing ejector to assure that nothing contained in the refuse is caught in the mechanism to prevent the full free swing of the ejector scoop.

BRIEF DESCRIPTION OF THE DRAWINGS

In the drawings wherein like numerals are utilized to designate like parts throughout the same.

DESCRIPTION OF THE ILLUSTRATIVE EMBODIMENT

The detailed description of the present invention involves a specific form, however, it is contemplated that other forms which might accomplish similar results might occur to those skilled in the art. In this regard, the illustrative embodiment is not intended to be limiting as to the scope of the invention in any manner whatsoever and it contemplates modifications, mechanical equivalents and the like.

Figure 1:
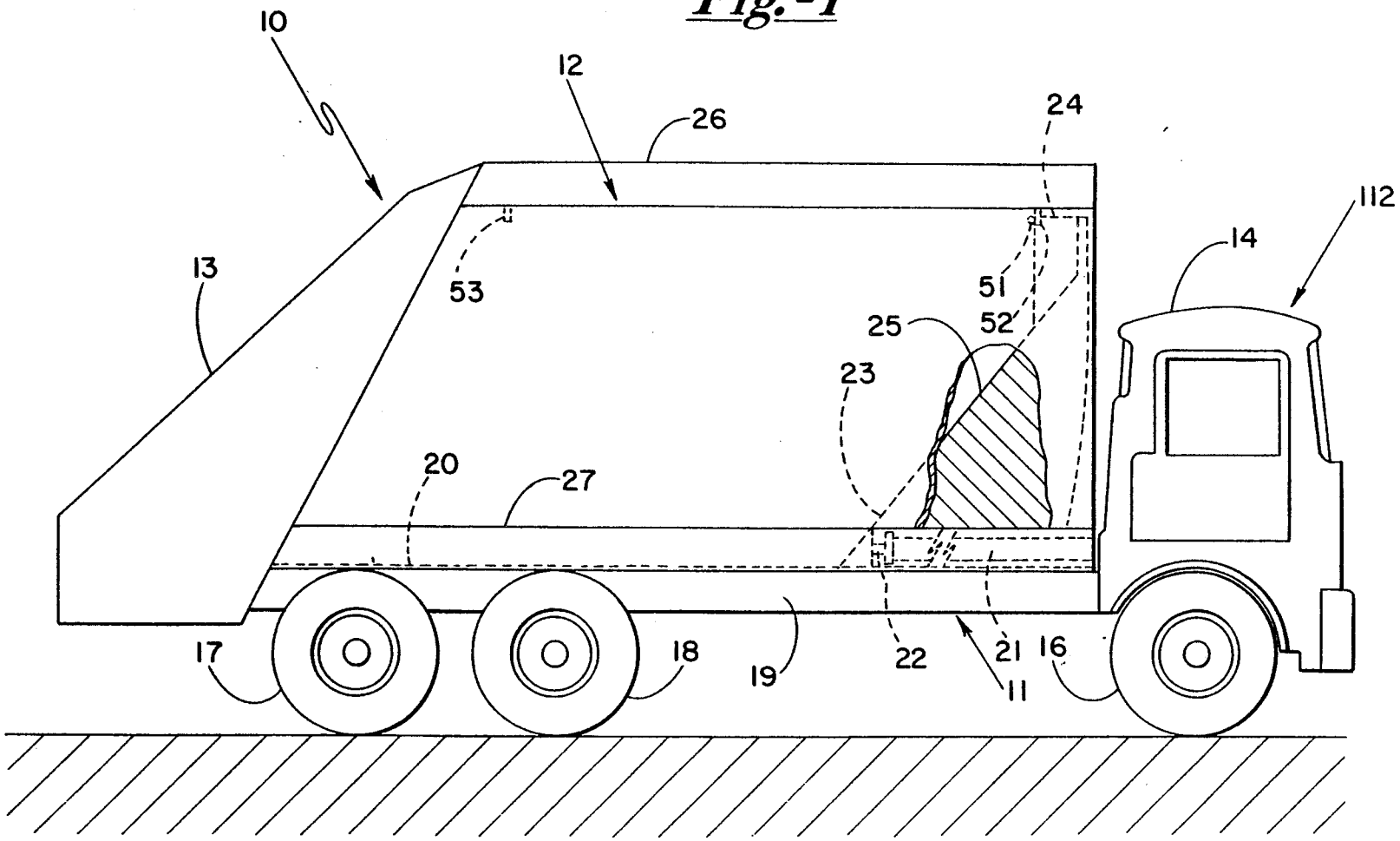
FIG. 1 is a side elevational view, with parts cut away, of a refuse pick-up vehicle including a truck chassis fitted with a refuse compactor body loading type further depicting relative amounts of wasted space between prior ejector mechanisms and that of the present invention.

FIG. 1 represents a complete refuse vehicle 10 which includes a truck body or chassis shown generally at 11, a refuse compactor body, shown generally at 12. The truck chassis itself may be of a class of conventional refuse-hauler type chassis including a steerable front axle assembly complete with wheels, etc. illustrated generally at 16 together with a two-axle rear suspension system likewise illustrated at 17 and 18. The chassis is connected by a relatively heavy box-supporting frame including member 19 which contains a central longitudinal trough structure 20 in which a fluid-operated cylinder 21 having an extensible piston rod 22 (both shown in phantom) is fixed. The location of the structure of a conventional refuse ejection pusher is shown by the dotted phantom lines 23 and that of the trough structure of the swing ejector of the present invention by the outline 24. The added refuse hauling volume made available by the use of the swing ejector mechanism of the invention is illustrated by the cross-hatched area 25. This also accomplishes some redistribution of the loading toward the front axle which is also desirable. The truck body further includes a refuse receiving section 13 and a conventional cab as at 14. The truck body top is indicated by 26 and the general floor level by 27.

Figure 2:
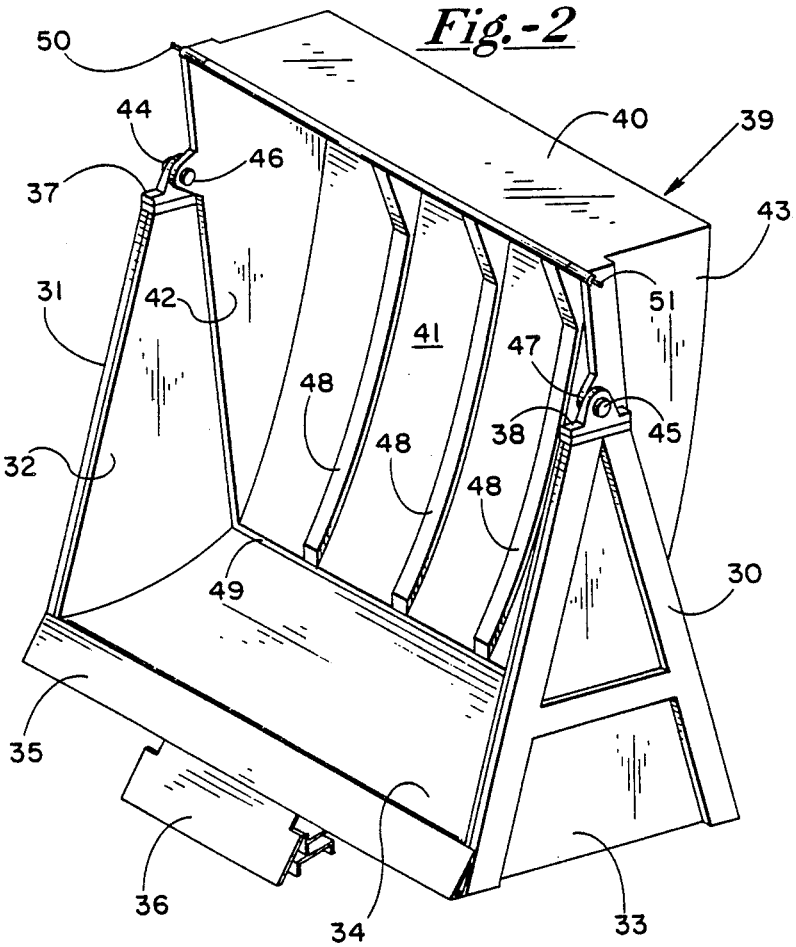
FIG. 2 is an enlarged elevational perspective view of the swing ejector mechanism of the invention.

FIG. 2 is an enlarged vertical perspective view of the swing ejector system of the invention. It includes a pair of substantially vertically disposed, horizontally spaced parallel "A-shaped" frames 30 and 31 covered by sheet metal, internally mounted side wall members 32 and 33 and arcuate bottom member 34. An angled rear bottom lip 35 is also fastened between the A-shaped members beneath the bottom as a further structure including a forward lip 36 which is designed to ride in a conventional central longitudinal ejection cylinder trough operated by an hydraulic cylinder in a well known manner.

A pair of journal members 37 and 38 which may be pillow block bearings are fixed on top of the A-shaped side frames and are adapted to carry a scoop-shaped ejector device, shown generally at 39 and having a top member 40, modestly arcuate curved front or bottom member 41, flanked by a pair of sheet metal sides 42 and 43, the top of which, carry a pair of short axles 44 and 45 mounted to ears 46 and 47 on the respective sides 42 and 43 and which are in turn journalled in the bearings 37 and 38 in a manner such that the scoop 39 is free to swing in a rotating manner journalled within the pair of bearings 37 and 38. Reinforcing ribs 48 add strength to the scoop. The bottom extremity 49 of the member 41 is designed to just clear the arcuate bottom member 34 as the scoop 39 swings to and fro.

Figure 3:
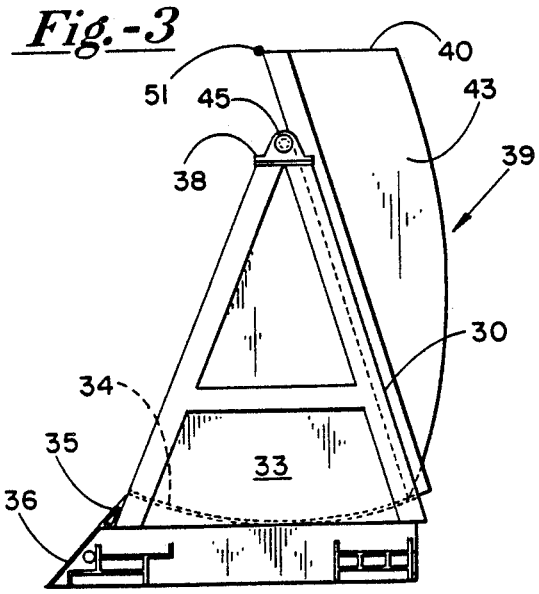
FIG. 3 and FIG. 4 depict the swing ejector mechanism in the loading and discharge positions, respectively.

It will be appreciated that in accordance with the invention, the pivot location for the scoop 39 may be varied and the bearings 37 and 38 may be raised or lowered relative to the illustrated location. In accordance with one embodiment of the swing ejector system of the invention the mounting is such that the completely unloaded position assumed by the scoop 39 will be that illustrated in FIG. 4 such that the lip of the scoop 49 coincides with the lip of the frame thereby allowing all the material contained in the scoop to slide easily outward from it. FIG. 3 generally shows the fully retracted or substantially vertical position of the scoop associated with a completely compacted or loaded vehicle and FIG. 4, the completely unloaded or neutral position taken by the scoop. Note that in FIG. 3 the top plate or side 40 is substantially horizontal and the scoop bottom 41 describes a substantially vertical wall such that very little space within the confines of the possible useable refuse containing reservoir is excluded.

Figure 4:
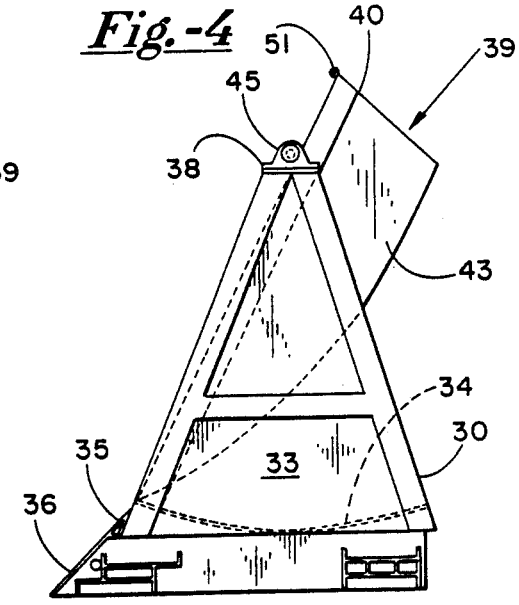

It is further noted that operating ears 50 and 51 may be provided on the top rear corners of the scoop 39 to cooperate with matching protuberances on the inside of the truck body as illustrated by pivot inducing means 52 and 53, respectively, to cause the scoop 39 to assume a vertical position as in FIG. 3 when the ejector is fully retracted into the truck body and to assume the discharge position of FIG. 4 when the ejector mechanism is pushed fully rearward within the truck body.

This invention has been described herein in considerable detail in order to comply with the Patent Statutes to provide those skilled in the art with the information needed to apply the novel principles and to construct and use such specialized components as are required. However, it is to be understood that the invention can be carried by modified or specifically different equipment and devices and that the variations and modifications both as to equipment details and operating procedures can be accomplished without departing from the scope of the invention itself.

What is claimed is:

1. A pivoting ejector system for use in a rear-loading, compacting refuse truck having a refuse holding volume, a forward and aft reciprocally slidable ejector in the refuse holding volume and a mechanical means for reciprocally displacing the ejector forward to accommodate loading and aft to unload the refuse, the ejector comprising:

a frame including a bottom frame portion connected to and spacing two parallel, substantially vertical A-shaped sidewall frames;

a pair of spaced pivot support means, one carried by each of the sidewall frames;

a pair of sidewall sheet members, one covering each of the sidewall frames;

the bottom frame portion further including load bearing means adapted to slidably support the ejector and allow it to operate in conjunction with the mechanical means for reciprocally displacing the ejector associated with the refuse truck; and a scoop-shaped pivoting structure having a top and modestly curved bottom mounted between the pair of sidewall members, the pivoting structure being carried by mounting means journalled in the pair of pivot support means carried by the sidewall frame members such that the pivoting structure is free to pivot forward and aft and having a bottom shape which cooperates with the sidewalls to provide a front for the refuse hauling volume with a modestly curved, substantially vertically disposed front wall when the top of the pivoting structure is pivoted to a rearward position.

2. The pivoting ejector system of claim 1 wherein the bottom frame portion is provided with a concave arcuately shaped interior surface facing the pivoting structure and wherein a lower end of pivoting structure generally remains spaced equidistant from the concave interior surface of the bottom frame as the pivoting structure is pivoted such that the lower end of the pivoting structure swings past and sweeps along the interior bottom surface.

3. The ejector system of claim 1 wherein said pivotal mounting of the ejector is such that the bottom of the ejector scoop tends to pivot rearward thereby forming a chute, if unrestrained, so that any material contained in the volume described by the ejector will tend to slide rearward toward a discharge end of the truck.

4. The ejector system of claim 1 further comprising fixed pivot inducing means mounted in a truck body near a rear thereof and adapted to contact the pivoting structure to cause the top of the pivoting structure to pivot forward when the ejector is displaced fully rearward in the truck.

5. The ejector system of claim 1 further comprising fixed pivot inducing means mounted in a truck body near a front thereof and adapted to contact the pivoting structure to cause the pivoting structure to pivot to position the modestly curved bottom of the pivoting structure in a substantially vertical position when the ejector is displaced fully forward in the truck.

6. An improved ejector system for use in a rear-loading, compacting refuse truck comprising:

a frame defining a bottom portion and two parallel spaced generally tapered, A-shaped sidewalls substantially perpendicular to the bottom which widen at the bottom and which, when vertical, further define a top peak and forward and rearward angles;

a pair of journalling means, one carried by each said sidewall;

the bottom portion including load bearing means adapted to reciprocally, slidably support the ejector above a surface on which it is placed, the bottom portion having a generally concave arcuate interior surface and a central load bearing means extending therebeneath;

a pivoting ejector structure mounted between the pair of sidewalls and defining a front wall of the refuse ejector structure, the ejector being generally scoop-shaped having a relatively shallow lower portion and relatively deep upper portion joined by side webs, the ejector being pivotally carried by a pair of oppositely disposed axle members mounted in the pair of journalling means carried by the sidewalls such that the pivoting ejector structure is free to pivot forward and aft, wherein the points of pivotal mounting of the ejector structure are such that, if unrestrained, a top of the ejector tends to pivot a distance, forward, the scoop shape thereby forming a discharge chute, so that any material contained in a volume described by the ejector will tend to be discharged when the ejector is displaced rearward and when the top of the ejector is pivoted aft describes a modestly curved, substantially vertically disposed front.

7. The ejector system of claim 1 wherein a lower end of pivoting structure generally remains spaced equidistant from the concave interior surface of the bottom frame as the pivoting structure is pivoted such that the lower end of the pivoting structure swings past and sweeps along the interior bottom surface.

* * * * *

UNITED STATES PATENT AND TRADEMARK OFFICE

CERTIFICATE OF CORRECTION

PATENT NO. : 5 067 868

DATED : November 26, 1991

INVENTOR(S) : Robert A. Boda

It is certified that error appears in the above-identified patent and that said Letters Patent is hereby corrected as shown below:

In column 6, line 47, delete "scoop" and insert -- ejector -- .

In column 6, line 54, change the dependency from "1" to -- 6 -- .

Signed and Sealed this

Thirteenth Day of April, 1993

*Attest:*

STEPHEN G. KUNIN

*Attesting Officer*

*Acting Commissioner of Patents and Trademarks*